US005702083A

United States Patent [19]

Lai

[11] Patent Number: 5,702,083

[45] Date of Patent: Dec. 30, 1997

[54] PNEUMATIC CYLINDER OF A PNEUMATIC LEVER-LIFT CHAIR, AND ITS ASSEMBLY PROCESS

[76] Inventor: Shiang-Hwey Lai, No. 23, Lane 1, Ta-Yuan 19 Str., Tai-Ping Hsiang, Taichung, Hsien, Taiwan

[21] Appl. No.: 633,317

[22] Filed: Apr. 17, 1996

[51] Int. Cl.[6] ..... F16M 11/00

[52] U.S. Cl. ..... 248/404; 248/161; 248/631; 267/64.12; 297/344.19

[58] Field of Search ..... 248/631, 622, 248/404, 188.2, 161, 159, 562; 297/344.18, 344.19, 344.12, 344.21; 267/64.12, 64.26, 118

[56] References Cited

U.S. PATENT DOCUMENTS

| | | | |
|---|---|---|---|
| 3,891,270 | 6/1975 | Crossman et al. | 248/404 |
| 4,720,068 | 1/1988 | Tornero | 248/631 |
| 4,940,202 | 7/1990 | Hosan et al. | 297/344.19 |
| 4,969,619 | 11/1990 | Bauer et al. | 248/161 |
| 5,078,351 | 1/1992 | Gualtieri | 248/161 |
| 5,413,414 | 5/1995 | Bauer | 297/344.18 |
| 5,443,573 | 8/1995 | Thiele et al. | 248/161 |
| 5,462,248 | 10/1995 | Bauer | 248/159 |
| 5,556,170 | 9/1996 | Lai et al. | 297/344.19 |

*Primary Examiner*—Ramon O. Ramirez
*Assistant Examiner*—Gwendolyn W. Baxter
*Attorney, Agent, or Firm*—Bacon & Thomas

[57] ABSTRACT

A pneumatic cylinder for use in a pneumatic lever-lift chair, including a cylindrical casing having an inward bottom flange and a plurality of vertically spaced inside annular flanges, a stop plate mounted inside the cylindrical casing and having a plurality of raised portions at the bottom respectively welded to the inward bottom flange of the cylindrical casing by a spot welding machine, and an inner barrel mounted inside the cylindrical casing and having an outward top flange stopped above the top end of the cylindrical casing and a plurality of vertically spaced annular grooves around the periphery respectively forced into engagement with the inside annular flanges of the cylindrical casing.

2 Claims, 6 Drawing Sheets

PNEUMATIC CYLINDER OF A PNEUMATIC LEVER-LIFT CHAIR, AND ITS ASSEMBLY PROCESS

BACKGROUND OF THE INVENTION

The present invention relates to the pneumatic system of a pneumatic lever-lift chair, and relates more particularly to the pneumatic cylinder of a pneumatic lever-lift chair and its assembly process.

Various hydraulic and pneumatic lever-lift chairs have been disclosed, and have appeared on the market. FIG. 1 shows a regular pneumatic lever-lift chair. This pneumatic lever-lift char comprises a pneumatic system controlled by a lever to adjust the height of the seat. The pneumatic system, as shown in FIGS. 2 and 3, comprises a cylindrical casing, a cylindrical casing having a top opening, a bottom opening, and an inward bottom flange projecting into the bottom opening, a stop plate mounted within the cylindrical casing and fixedly secured to the inward bottom flange of the cylindrical casing, an inner barrel mounted in the top opening of the cylindrical casing by plugging, and a seat stem inserted through the inner barrel and connected to the center through hole of the stop plate by a cushion and a fastening element. The installation of the stop plate may be achieved by two methods. One method is to fixedly secure the stop plate to the inward bottom flange of the cylindrical casing by welding. However, welding to the stop plate to the inward bottom flange of the cylindrical casing needs a special technique, and only a specially trained technician can do the job. Furthermore, the welding quality is difficult to be maintained at the desired level. The other method is to make a dent around the periphery of the cylindrical casing corresponding to the location of the stop plate, permitting the stop plate to be fixed to the inward bottom flange of the cylindrical casing by the dent. However, because the periphery of the cylindrical casing is a smoothly curved surface, it is difficult to evenly ram the periphery of the cylindrical casing in making the desired dent. Another drawback of the aforesaid structure of pneumatic system is that the inner barrel tends to displace. Because the inner barrel is fastened to the cylindrical casing by plugging, it tends to be forced to deform and to displace after a long use of the chair or when the chair is rotated. Further, because the inner barrel is molded from plastic, it expands when hot and shrinks when cold. When the inner barrel is caused to deform, the seat stem will deviate from the course, and will cause the inner barrel to break when moved.

SUMMARY OF THE INVENTION

It is one object of the present invention to provide a pneumatic cylinder for use in a pneumatic lever-lift chair which fixedly secures the stop plate and the inner barrel in place, and effectively protect the inner barrel against deformation. It is another object of the present invention to provide a pneumatic cylinder assembly process which is easy to perform. According to the present invention, the installation of the stop plate is achieved by: processing raised portions at the bottom side of the stop plate, then welding the raised portions of the stop plate to the inward bottom flange of the cylindrical casing by a spot welding machine, and then ramming a dent around the periphery of the cylindrical casing, permitting the dent to be engaged with the top of the stop plate; the installation of the inner barrel is achieved by: making a plurality of vertically spaced inside annular flanges around the periphery of the cylindrical casing and a plurality of vertically spaced outside annular grooves around the periphery of the inner barrel, and then inserting the inner barrel into the cylindrical casing and forcing the outside annular grooves of the inner barrel into engagement with the inside annular flanges of the cylindrical casing.

DETAILED DESCRIPTION OF THE PREFERRED EMBODIMENT

Figure 1:
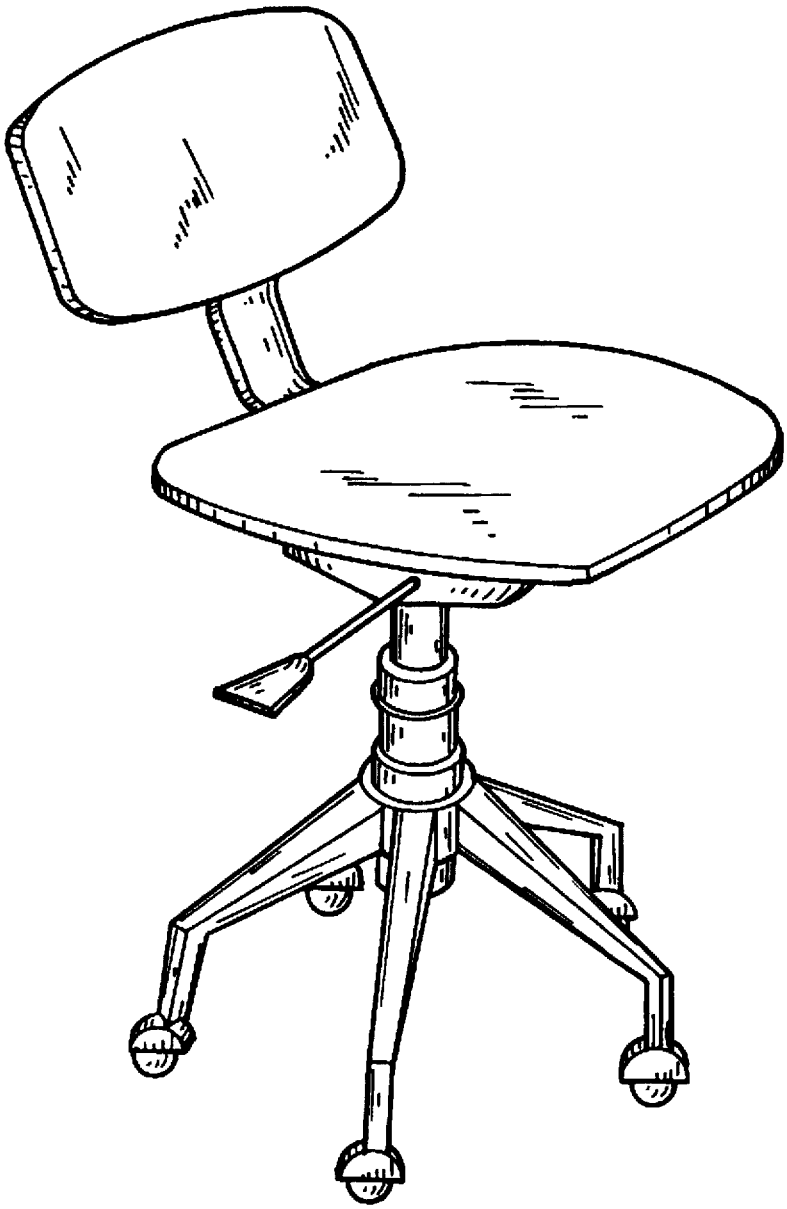
Fig. 1 PRIOR ART
FIG. 1 shows the structure of a regular pneumatic lever-lift chair.
Figure 2:
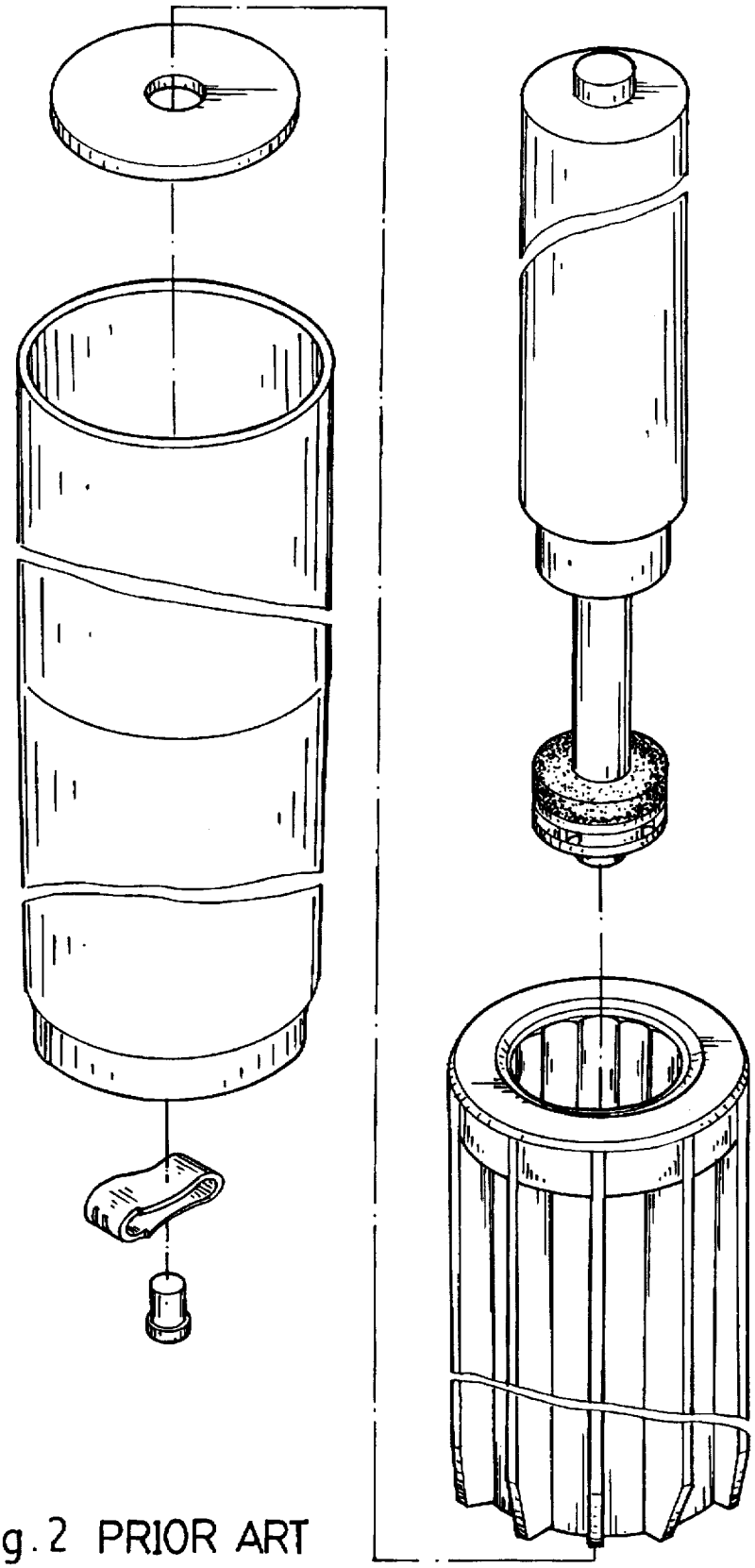
Fig. 2 PRIOR ART
FIG. 2 is an exploded view of a pneumatic cylinder for use in a pneumatic lever-lift chair according to the prior art.
Figure 3:
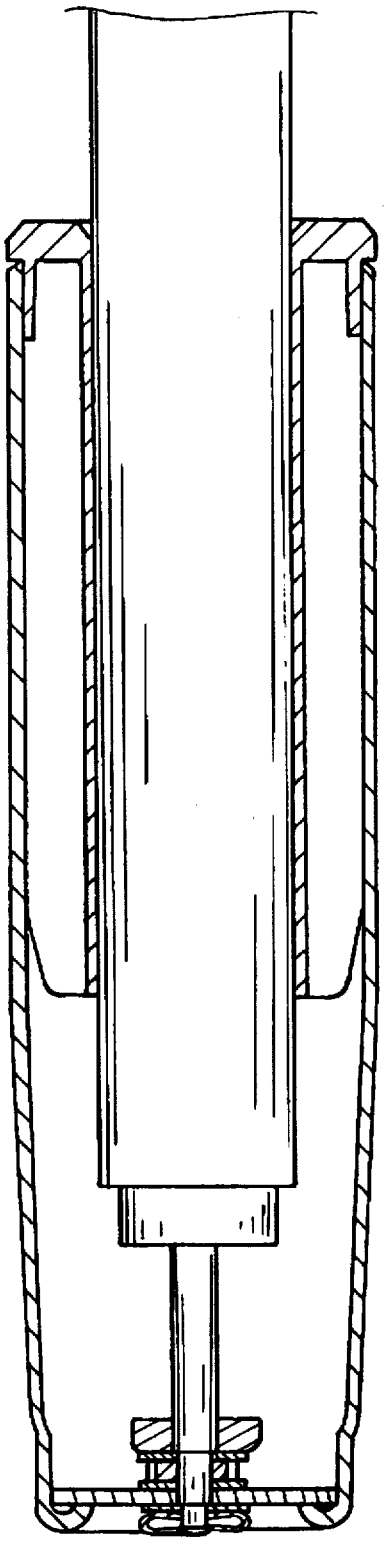
Fig . 3 PRIOR ART
FIG. 3 is a sectional assembly view of the pneumatic cylinder shown in FIG. 2.
Figure 4:
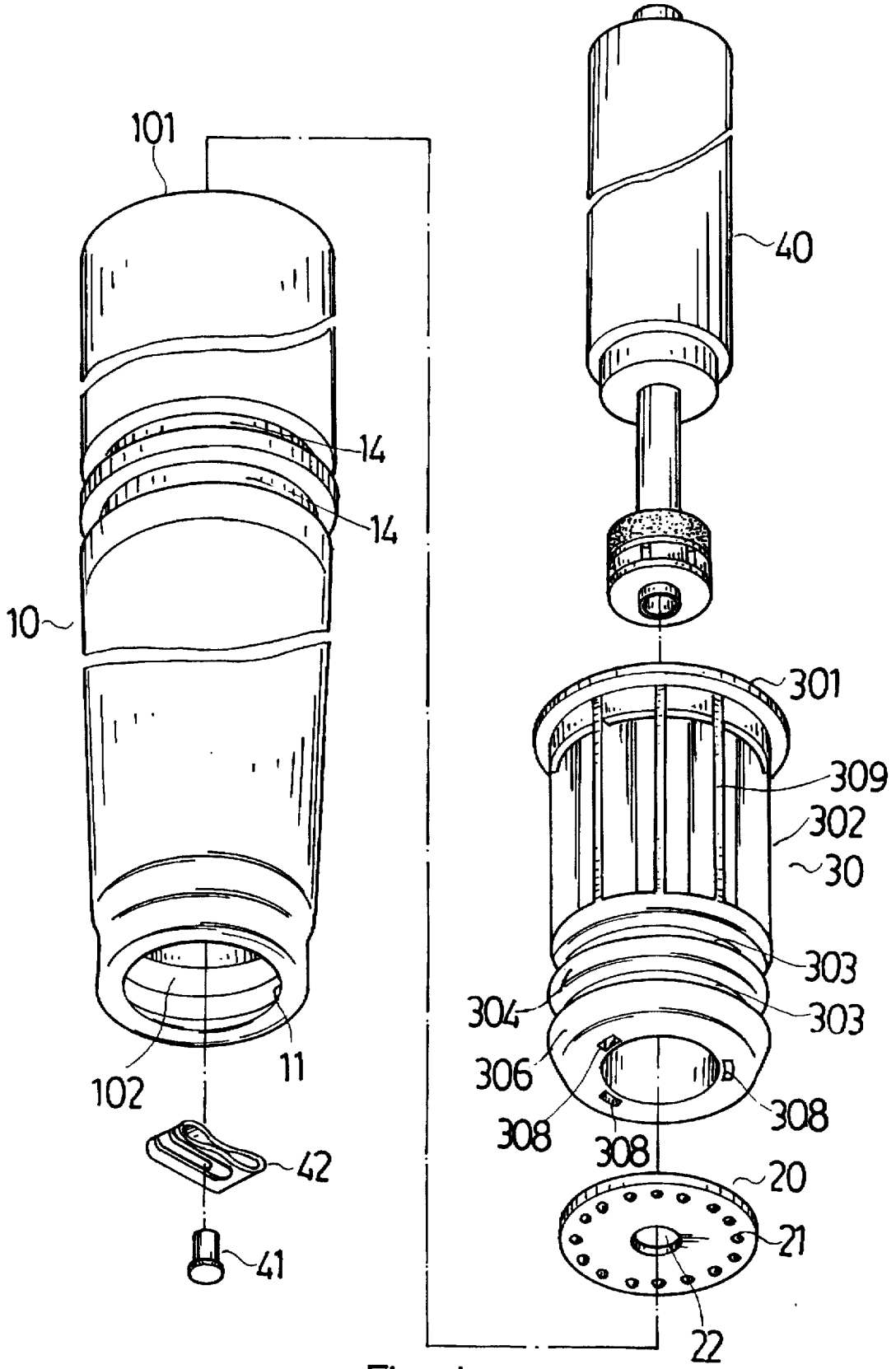
FIG. 4 is an exploded view of a pneumatic cylinder for use in a pneumatic lever-lift chair according to the present invention.
Figure 5:
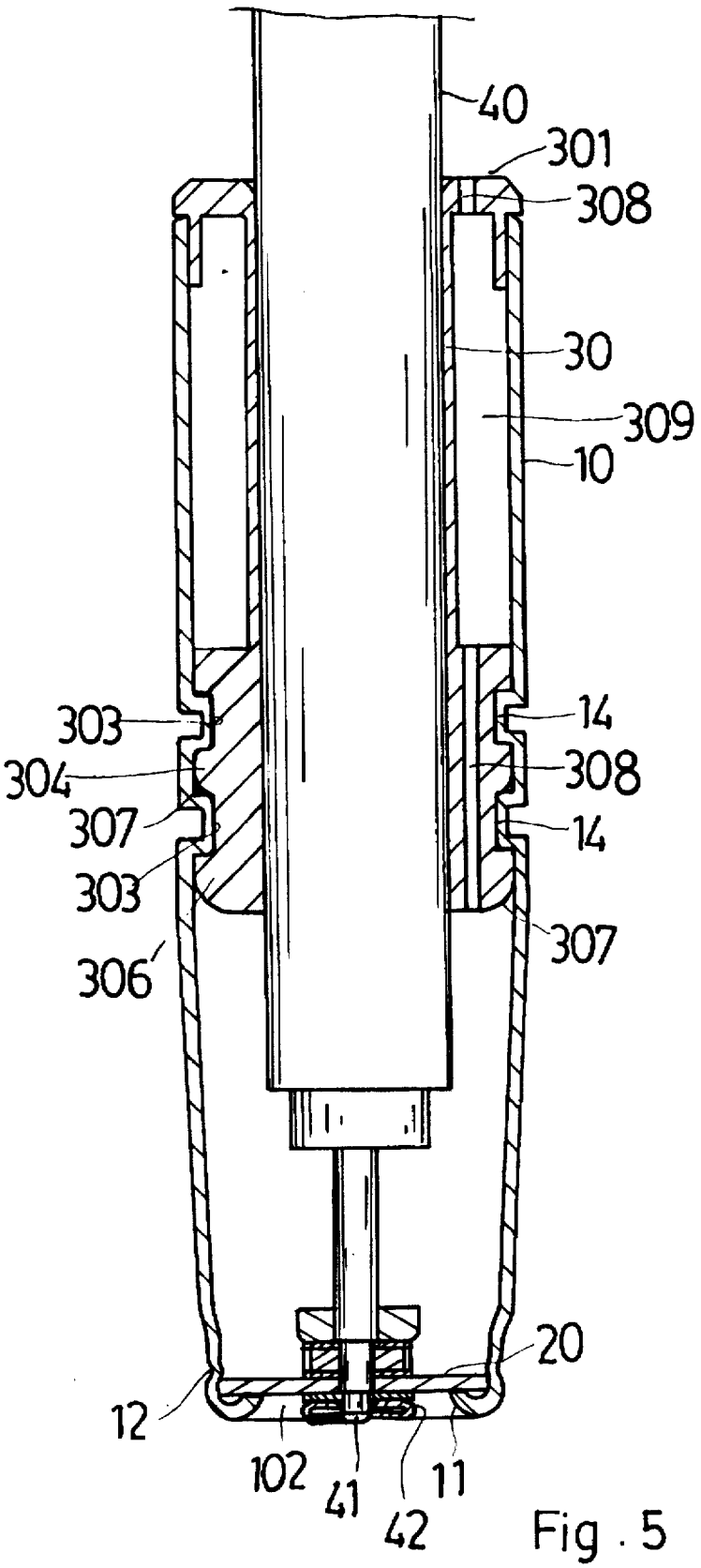
FIG. 5 is a sectional assembly view of the pneumatic cylinder shown in FIG. 4.
Figure 6:
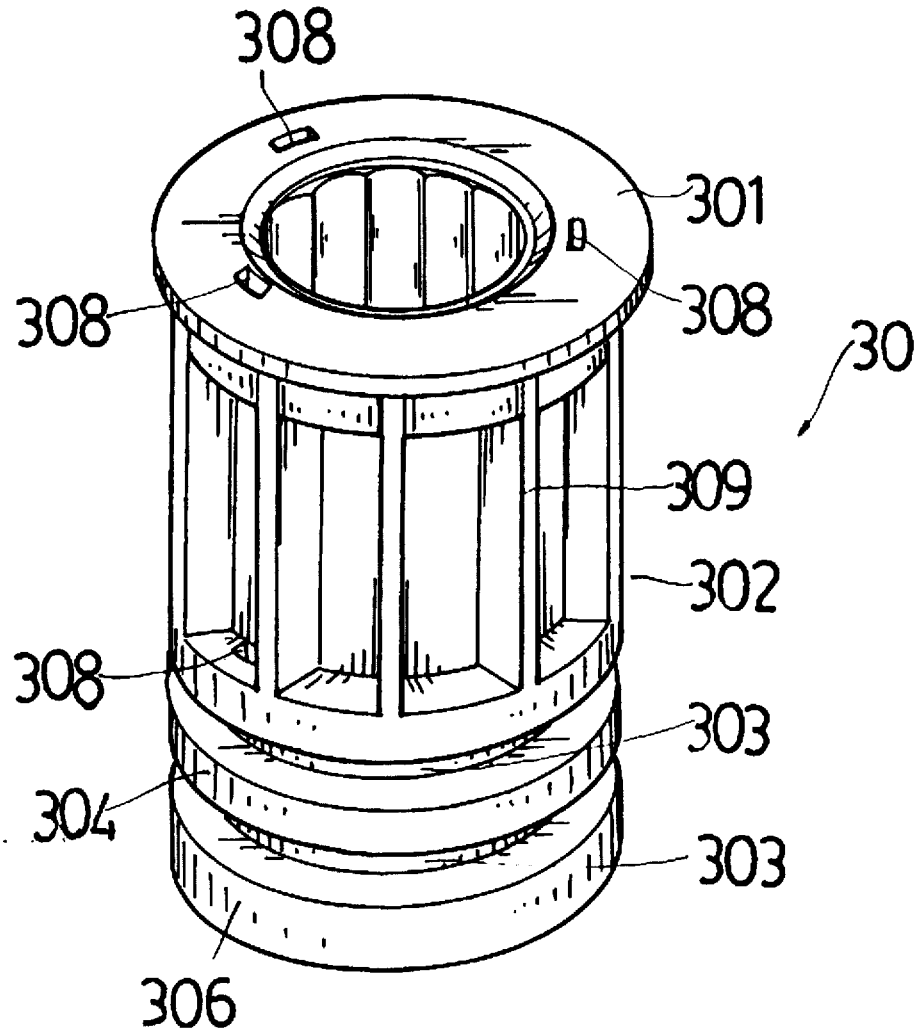
FIG. 6 is an elevational view of the inner barrel of the pneumatic cylinder shown in FIG. 4.

Referring to FIGS. 4, 5, and 6, a pneumatic cylinder in accordance with the present invention is generally comprised of a cylindrical casing 10, a stop plate 20, an inner barrel 30. The casing 10 has a top opening 101, a bottom opening 102, and an inward bottom flange 11 projecting into the bottom opening 102 and formed by bending the bottom end of the casing 10 inwards. The stop plate 20 is mounted within the casing 10, having a center through hole 22, and a plurality of raised portions 21 raised from the bottom side around the center through hole 22 and welded to the inward bottom flange 11 of the casing 10. The inner barrel 30 is a hollow member adapted for the passing of a seat stem 40, which has a bottom end fixedly secured to the center through hole 22 of the stop plate 20 by a cushion 42 and a fastening element 41. The inner barrel 30 comprises a hollow cylindrical body 302, an outward top flange 301 raised from the periphery of the top end of the body 302 and stopped above the top opening 101 of the cylindrical casing 10, a plurality of longitudinal ribs 309 equiangularly spaced around the upper part of outside wall of the cylindrical body 302, a plurality of outside annular grooves 303 vertically spaced around the lower part of the outside wall of the cylindrical body 302 and defining a convex portion 304 between each two adjacent outside annular grooves 303, a bottom flange 306, and a plurality of longitudinal exhaust holes 308 through the outward top flange 301 and the bottom flange 306 at locations corresponding to the longitudinal ribs 309. The convex portions 304 and the bottom flange 306 have a respective circularly chamfered bottom edge 307. The cylindrical casing 10 has a plurality of inside annular flanges 14 spaced around the periphery at different elevations and engaged with the annular grooves 303 of the inner barrel 30.

The assembly process of the present invention includes the steps of:

(A) processing the stop plate 20 to form a plurality of raised portions 21 at the bottom side of the stop plate 20 around the border corresponding to the inward bottom flange 11 of the cylindrical casing 10, then putting the stop plate 20 in the cylindrical casing 10, permitting the raised portions 21 to be disposed in contact with the inward bottom flange 11 of the cylindrical casing 10;

(B) welding the raised portions 21 of the stop plate 20 to the inward bottom flange 11 of the cylindrical casing 10 by a spot welding machine;

(C) processing a dent 12 around the periphery of the cylindrical casing 10 to force the dent 12 into engagement with the top of the stop plate 20;

(D) inserting the inner barrel 30 into the cylindrical casing 10 and forcing the annular grooves 303 of the inner barrel 30 into engagement with the inside annular flanges 14 of the cylindrical casing 10.

The advantages of the present invention are outlined hereinafter. Because raised portions 21 are made at the bottom side of the stop plate 20, the the stop plate 20 can be easily welded to the inward bottom flange 11 of the cylindrical casing 10 by a spot welding machine when it is mounted inside the cylindrical casing 10. As the operation of a spot welding machine is easy, and any person can operate it through a simple training. It is economic to secure the stop plate to the inward bottom flange of the cylindrical casing by a spot welding machine. Furthermore, welding the stop plate to the inward bottom flange of the cylindrical casing by a spot welding machine achieves a better welding quality. With respect to the inner barrel 30, the inside air of the cylindrical casing 10 must be expelled to the outside so that the inner barrel 30 can be smoothly inserted into the inside of the cylindrical casing 10. When the inner barrel 30 is inserted into the cylindrical barrel 10, the inside air of the cylindrical casing 10 is expelled to the outside through the exhaust holes 308. Because of the design of the chamfered bottom edges 307 of the bottom flange 306 and convex portions 304 of the inner barrel 30, the bottom flange 306 and convex portions 304 of the inner barrel 30 can be forced to pass over the the inside annular flanges 14 of the cylindrical casing 10, permitting the annular grooves 303 of the inner barrel 30 to be forced into engagement with the inside annular flanges 14 of the cylindrical casing 10. When assembled, the inner barrel 30 does not displace relative to the cylindrical casing 10 even when it is caused to expand when hot or to shrink when cold, or damaged by an external force.

I claim:

1. A pneumatic cylinder for use in a pneumatic lever-lift chair, and its assembly process, the pneumatic cylinder comprising a cylindrical casing having a top opening, a bottom opening, and an inward bottom flange projecting into said bottom opening, a stop plate mounted within said cylindrical casing and fixedly secured to the inward bottom flange of said cylindrical casing, and an inner barrel mounted inside said cylindrical casing, wherein:

said stop plate has a plurality of raised portions at a bottom side respectively welded to the inward bottom flange of said cylindrical casing;

said cylindrical casing comprises a dent formed around the periphery and stopped above said stop plate, and a plurality of inside annular flanges vertically spaced around the periphery above said dent;

said inner barrel comprises a hollow cylindrical body, an outward top flange stopped above the top opening of said cylindrical casing, a plurality of longitudinal ribs equiangularly spaced around an upper part of said cylindrical body on the outside, a plurality of outside annular grooves vertically spaced around a lower part of said cylindrical body on the outside and defining a plurality of vertically spaced convex portion between each two adjacent outside annular grooves, a bottom flange, and a plurality of longitudinal exhaust holes through the outward top flange and bottom flange of said inner barrel at locations corresponding to said longitudinal ribs, the convex portions and bottom flange of said inner barrel having a respective circularly chamfered bottom edge, the annular grooves of said inner barrel being forced into engagement with the inside annular flanges of said cylindrical casing respectively.

2. The assembly process of the pneumatic cylinder of claim 1 including the steps of:

(A) putting said stop plate into said cylindrical casing, permitting the raised portions of said stop plate to be disposed in contact with the inward bottom flange of said cylindrical casing;

(B) welding the raised portions of said stop plate to the inward bottom flange of said cylindrical casing by a spot welding machine;

(C) processing a dent around the periphery of said cylindrical casing, permitting said dent to be forced into engagement with the topmost edge of said stop plate; and (D) inserting said inner barrel into said cylindrical casing and forcing the annular grooves of said inner barrel into engagement with the inside annular flanges of said cylindrical casing.

* * * * *